US006962067B1

(12) United States Patent
Chapman

(10) Patent No.: US 6,962,067 B1
(45) Date of Patent: Nov. 8, 2005

(54) TOOLBOX SECURITY FRAME

(76) Inventor: Bryant Dean Chapman, HC31, Box 771, Sandy Valley, NV (US) 89019

( * ) Notice: Subject to any disclaimer, the term of this patent is extended or adjusted under 35 U.S.C. 154(b) by 0 days.

(21) Appl. No.: 10/270,902

(22) Filed: Oct. 15, 2002

(51) Int. Cl.[7] ..... E05B 73/00
(52) U.S. Cl. ..... 70/18; 70/158; 70/163
(58) Field of Search ..... 70/14, 18, 51–56, 70/158, 163, 164; 109/49.5, 50–52; 292/259 R

(56) References Cited

U.S. PATENT DOCUMENTS 1,812,826 A * 6/1931 Frick ..... 292/1
2,263,862 A * 11/1941 Usmar ..... 312/236
3,741,132 A * 6/1973 Blower ..... 109/52
4,191,034 A * 3/1980 Froess et al. ..... 70/258
4,406,358 A * 9/1983 Zahradnik ..... 194/350
4,418,551 A * 12/1983 Kochackis ..... 70/18
4,495,787 A * 1/1985 Comstock ..... 70/258
4,538,827 A * 9/1985 Plifka ..... 280/507
4,664,041 A * 5/1987 Wood ..... 109/51
5,108,166 A * 4/1992 Klix ..... 312/329
5,488,914 A * 2/1996 Ouellette ..... 109/56
5,527,056 A * 6/1996 Hoagland ..... 280/507
5,746,140 A * 5/1998 Flood ..... 109/50
6,125,672 A * 10/2000 Diez ..... 70/226
6,237,375 B1 * 5/2001 Wymer ..... 70/14
6,298,695 B1 * 10/2001 Vezina et al. ..... 70/58

* cited by examiner

*Primary Examiner*—John B. Walsh
(74) *Attorney, Agent, or Firm*—Leonard Weiss

(57) ABSTRACT

A toolbox security frame includes a lower frame that may be placed within a cage with a rear member of the lower frame extending therefrom. The rear member has ends that extend to the exterior of the lower frame. Each of the ends has a lock bar hole therethrough. Sides of a lower part of the cage form lock bar passageways that are each in registration with one of the lock bar holes. A front of the lower cage has a member with a notch therein. A front member of the lower frame has a padlock receptacle with a receptacle hole therethrough. The padlock receptacle extends to the exterior of the lower frame where it is within the notch. A central part of a U shaped lock bar includes a pair of tabs with a hole therethrough that are in registration with the receptacle hole. The lock bar has sides that each extend through one of the passageways and one of the lock bar holes. A bolt of a padlock may be passed through the tab holes and the receptacle hole to prevent unauthorized access to a toolbox within the security frame.

4 Claims, 3 Drawing Sheets

TOOLBOX SECURITY FRAME

BACKGROUND OF THE INVENTION

1. Field of Invention

This invention is in the general field of anti-theft devices and, more particularly, is a frame that fastens a toolbox to a bed of a truck and prevents the toolbox from being opened.

2. Description of the Prior Art

An artisan typically has to transport himself and his tools from a storage cite near his home to a job site where some of the tools may be used. The transportation is often via a light truck that is owned by the artisan. At the job site, the truck with a toolbox containing many of the tools may be unattended for lengthy periods of time.

The truck usually does not have a trunk with a lock where the toolbox can be stored. When the toolbox is stored in a closed passenger compartment of the unattended truck, there is a likelihood that the toolbox will be stolen. When the truck does not have the closed passenger compartment, there is an increased likelihood that the toolbox will be stolen.

Heretofore, there has been no known way of securely storing the toolbox with tools in the truck. It is desirable for the artisan to be able to store the toolbox upon a bed of the truck in a manner the prevents the toolbox from being stolen from the truck and prevents tools from being stolen from the toolbox.

SUMMARY OF THE INVENTION

An object of the present invention, is to prevent theft of a toolbox from a truck.

Another object of the invention is to prevent a theft of tools from a toolbox in a truck.

A toolbox security frame includes a lower frame, a cage and a lock bar. A rear member of the lower frame has ends that extend to the exterior of the lower frame. A lock bar hole is through each of the ends.

A front member of the lower frame has its center connected to a padlock receptacle that extends to the exterior of the lower frame. The padlock receptacle has a receptacle hole therethrough.

The cage has an upper part made from members rectangularly disposed. The cage additionally includes a lower U part made from members in a U shaped disposition. A central portion of the lower part has a notch therein. Sides of the lower part each form a lock bar passageway.

The lock bar is made from a rod that is bent to form a U shape. A pair of padlock tabs with padlock holes therethrough are connected side by side proximal to the center of the rod.

When the lower frame is within the cage, each of the lock bar passageways are in registration with one of the lock bar holes. Additionally, the padlock receptacle extends through the notch, between the padlock tabs and the receptacle and padlock holes are in registration. The lock bar is disposed along the front and sides of cage. Additionally, sides of the lock bar extend through the lock bar passageways and ends of the lock bar are within the lock bar holes.

Other objects, features and advantages of the invention should be apparent from the following description of a preferred embodiment of the invention as illustrated in the accompanying drawing.

DESCRIPTION OF THE PREFERRED EMBODIMENT

Figure 1:
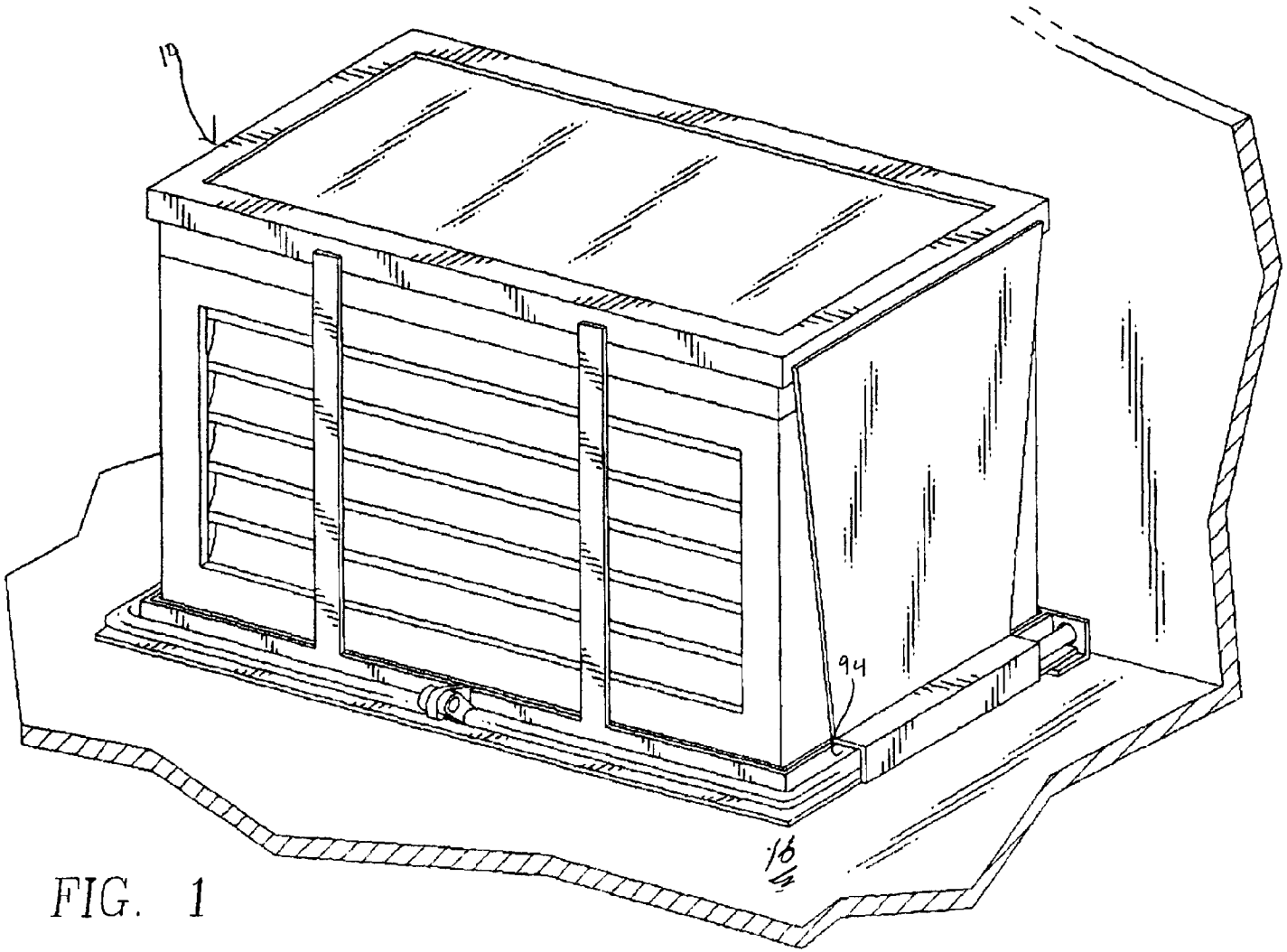
FIG. 1 is a perspective view of a toolbox within a toolbox security frame.
Figures 2, 2A:
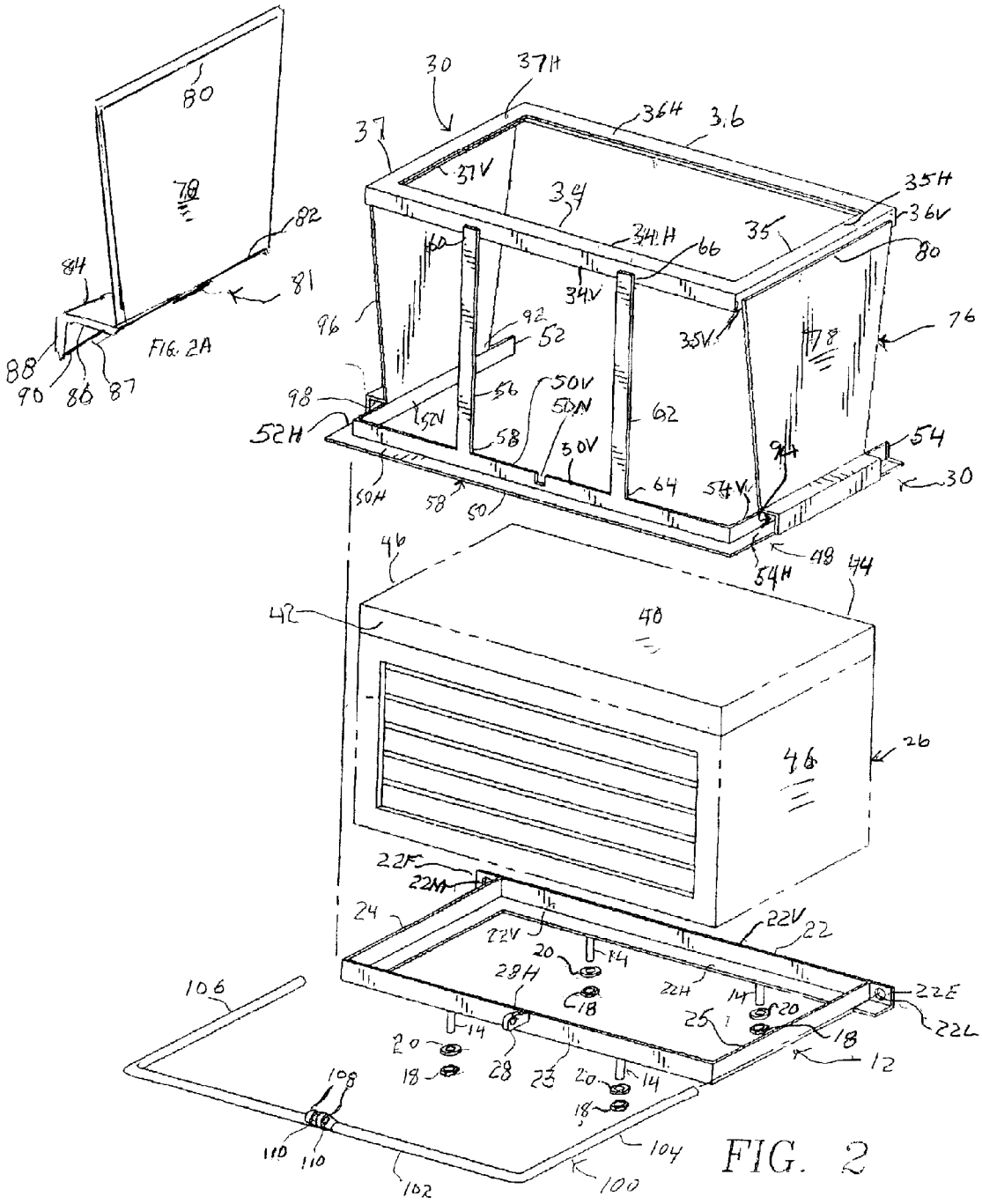
FIG. 2 is an exploded perspective view of the tool box and the security frame of FIG. 1.
FIG. 2A is a perspective view of a plate of a cage of the security frame of FIG. 2.

As shown in FIGS. 1 and 2, a security frame 10 includes a lower frame 12 (FIG. 2). A plurality of threaded bolts 14 are connected to the lower frame 12. The bolts 14 fit through holes (not shown) in a bed 16 of a truck (FIG. 1). A washer 20 is placed upon each of the bolts 14. A screw 18 that screws onto each of the bolts 14 maintains the washer 20 thereon and fixedly connects the lower frame 12 to the bed 16.

The lower frame 12 includes a rear member 22 and a front member 23 that are connected together by side members 24, 25. The members 22–25 are rectangularly disposed. Additionally, the members 22–25, have L shaped cross sections.

The member 22, has horizontal and vertical portions 22H, 22V, respectively, with the portion 22H extending to the interior of the lower frame 12. Similarly, the members 23–25 have horizontal and vertical portions with the horizontal portions extending to the interior of the lower frame 12.

Because the portion 22H and the horizontal portions of the members 23–25 extend to the interior of the lower frame 12, when the frame 12 rests upon the bed 16, a tool box 26 placed within the frame 12 rests upon the portion 22H and the horizontal portions of the members 23–25. Moreover, the vertical portion 22V and vertical portions of the members 23–25 maintain the tool box 26 within the lower frame 12.

The member 22 has ends 22E, 22F that extend to the exterior of the lower frame 12. The ends 22E, 22F have lock bar holes 22L, 22M respectively therethrough.

The member 24 is connected to a padlock receptacle 28 that extends to the exterior of the lower frame 12. The receptacle 28 has a hole 28H therethrough.

The security frame 10 additionally includes a cage 30 with an upper part 32 made from members 34–37 that are connected together. The members 34–37 have a rectangular disposition. Additionally, the members 34–37 have L shaped cross sections.

The members 34–37 have horizontal portions 34H–37H respectively, that extend to the interior of the upper part 32. Additionally, the members 34–37 have vertical portions 34V–37V, respectively.

When the toolbox 26 is within the security frame 10, the portions 34H–37H extend over edges of a top 40 of the tool box 26 and the portions 34V, 37V extend downward over an upper part of a front 42 and rear 44, respectively, of the toolbox 26. Additionally, the portions 35V, 37V extend downward over an upper part of sides 46 of the toolbox 26. Hence, the members 34–37 prevent a lifting of the toolbox 26 from the security frame 10.

The cage 30 additionally includes a lower part 48 that includes a front member 50 and side members 52, 54. Ends of the member 50 are respectively connected perpendicularly to the members 52, 54. Accordingly, the members 50, 52, 54 have a U shaped disposition.

The members 50, 52, 54 all have an L shaped cross section with horizontal portions 50H, 52H, 54H, respectively, that extend outward from the lower part 48. The members 50, 52, 54 additionally have vertical portions 50V, 52V, 54V. The portion 50V has a notch 50N therein.

The portion 50V is integrally connected to a bar 56 at an end 58 thereof. An end 60 of the bar 56 is welded onto the portion 34V. Similarly, the portion 50V is integrally connected to a bar 62 at an end 64 thereof. An end 66 of the bar 62 is welded onto the portion 34V. When the toolbox 26 is within the security frame 10, the bars 56, 62 are proximal to the front 42, thereby preventing tools from being taken from the toolbox 26.

A side 76 of the cage 30 includes a generally trapezoidal plate 78 that has an end 80 welded onto the portion 35V. As shown in FIG. 2A, the plate 78 is bent to form an edge 82 and an edge 84 that are parallel. Between the edges 82, 84 a rectangular strip 86 is defined. The strip 86 is perpendicular to the plate 78. Additionally, a metal strip 88 is defined that is perpendicular to the strip 86.

The edge 82 is welded onto the portion 54V. An end 90 of the strip 88 is welded onto the portion 54H. The strips 86,88 and the portions 54V, 54H form a lock bar passageway 94.

A side 96 of the cage 30 is similar to the side 76. The side 96 is connected to portions 37V, 52V in a manner similar to the connection of the side 76 to the portions 35V, 54V to form a lock bar passageway 98.

When the lower frame 12 is within the cage 30, it rests upon the bed 16 with the passageways 94, 98 in registration with the holes 22L, 22M, respectively. Additionally, the padlock receptacle 28 extends through the notch 58N and the member 22 extends from the open end of the part 56.

A padlock bar 100 (FIG. 2) is used in a manner explained hereinafter to prevent an undesired removal of the tool box 26 from the security frame 10. The padlock bar 100 is a metal rod that is bent to have a U shape with a bottom 102 of the U connected to sides 104, 106 of the U.

A pair of spaced padlock tabs 108 are welded proximal to the center of the bottom 102. The tabs 108 each have a hole 110 therethrough.

Figure 3:
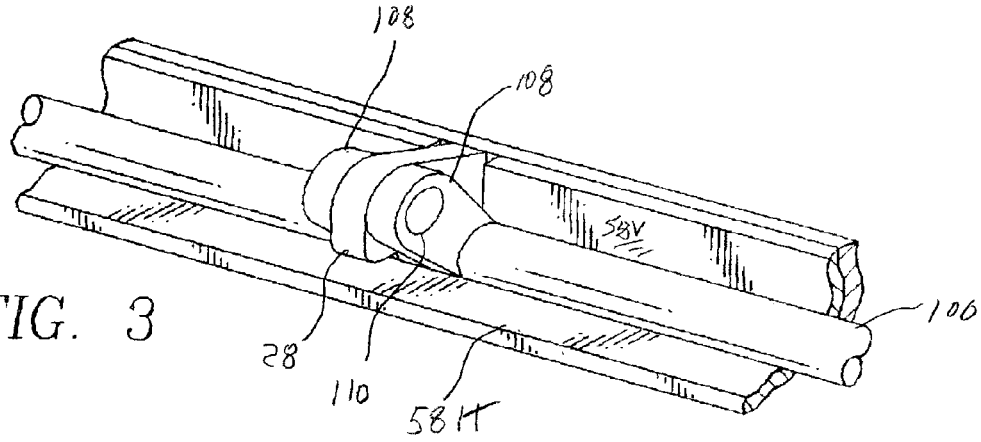
FIG. 3 is a perspective view of padlock tabs of a lock bar receptacle and a padlock receptacle.
Figure 4:
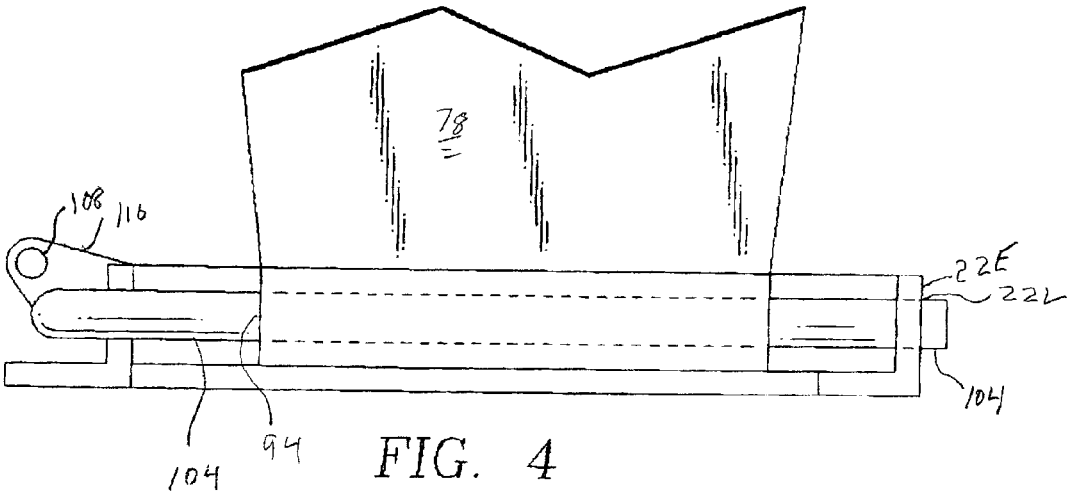
FIG. 4 is a side elevation of the lock bar of FIG. 1.

As shown in FIGS. 3 and 4, with further reference to FIG. 2, when the padlock bar 100 is used, the side 104 extends through the passageway 94 and the hole 22L. In a similar manner, the side 106 extends through the passageway 98 and the hole 22M. The holes 36, 108 are in registration, whereby a bolt of a padlock may be passed therethrough to prevent unauthorized access to the tool box 26 when it is within the security frame 10.

While the invention has been particularly shown and described with reference to a preferred embodiment thereof, it should be understood by those skilled in the art that changes in form and detail may be made therein without departing from the spirit and scope of the invention.

What is claimed is:

1. A security frame wherein a toolbox may be kept, comprising:

a lower frame made from front and rear members that are connected together by side members, said lower frame members having a disposition that defines a rectaggle, said lower frame being adapted for connection to a bed of a truck;

a cage having an upper part in the shape of a rectangle and a U shaped lower part wherein said rear member has ends that extend to the exterior of said rectangle, each of said ends having a hole therethrough, sides of said cage each comprising a plate having one end connected to said upper part, said plate being bent proximal to its other end to form first and second parallel edges with a first strip that is perpendicular to said plate being formed between said edges and a second strip that is parallel to said plate extending from said second edge and means for retaining said lower frame within said cage.

2. The security frame of claim 1 wherein said first edge and an end of said second strip are connected to said lower frame to form a lock bar passageway that is in registration with the hole through one of said ends when said lower frame is within said cage.

3. The security frame of claim 1 wherein a front member of said lower part has a notch therein and a member of said lower frame being connected to a padlock receptacle that and extends through said notch when said lower frame is within said cage.

4. The security frame of claim 2 wherein said means for retaining is a padlock bar comprising:

a metal bar that is bent to have a U shape with a bottom of the U connected to its sides; and a padlock tab having a hole therethrough connected proximal to the center of said bottom.

* * * * *